US009394490B2

(12) United States Patent
Trucko et al.

(10) Patent No.: US 9,394,490 B2
(45) Date of Patent: Jul. 19, 2016

(54) PROCESS FOR REMOVING CARBONYL SULFIDE FROM A HYDROCARBON STREAM

(71) Applicant: UOP LLC, Des Plaines, IL (US)

(72) Inventors: Jessy E. Trucko, Lake Forest, IL (US); Jonathan A. Tertel, Mount Prospect, IL (US); Luigi Laricchia, Arlington Heights, IL (US); Javier Rios, Montgomery, IL (US)

(73) Assignee: UOP LLC, Des Plaines, IL (US)

( * ) Notice: Subject to any disclaimer, the term of this patent is extended or adjusted under 35 U.S.C. 154(b) by 289 days.

(21) Appl. No.: 14/177,868

(22) Filed: Feb. 11, 2014

(65) Prior Publication Data

US 2015/0225653 A1 Aug. 13, 2015

(51) Int. Cl.
*C10G 25/12* (2006.01)
*C10G 21/08* (2006.01)

(52) U.S. Cl.
CPC ..... *C10G 25/12* (2013.01); *C10G 21/08* (2013.01); *C10G 2300/202* (2013.01)

(58) Field of Classification Search
CPC ..... C10G 25/12; B01D 53/0423; B01D 53/1418; B01D 53/485; B01D 2257/308
See application file for complete search history.

(56) References Cited

U.S. PATENT DOCUMENTS

| | | | | |
|---|---|---|---|---|
| 3,265,757 | A | 8/1966 | Frevel et al. | |
| 3,315,003 | A | 4/1967 | Khelghatian | |
| 4,299,802 | A | 11/1981 | Tellis | |
| 4,455,446 | A | 6/1984 | Brownell et al. | |
| 4,835,338 | A * | 5/1989 | Liu | C07C 7/12 208/230 |
| 4,971,682 | A | 11/1990 | Clark | |
| 5,114,689 | A * | 5/1992 | Nagji | B01D 53/02 208/208 R |
| 5,298,228 | A * | 3/1994 | Palomares | B01D 53/18 423/210 |
| 6,843,907 | B1 * | 1/2005 | Kanazirev | C10G 25/003 208/208 R |
| 7,825,056 | B2 | 11/2010 | Le Bec et al. | |
| 8,043,589 | B2 | 10/2011 | Herold et al. | |
| 2007/0119751 | A1 | 5/2007 | Weston et al. | |
| 2011/0142738 | A1 * | 6/2011 | Pandya | B01D 53/52 423/224 |

FOREIGN PATENT DOCUMENTS

| | | | |
|---|---|---|---|
| EP | 341572 | B1 | 12/1992 |
| EP | 580736 | B1 | 4/1997 |
| EP | 648720 | B1 | 4/1997 |
| WO | WO 92/17428 | | 10/1992 |

OTHER PUBLICATIONS

Watson et al., "Study compares COS-removal processes," Oil & Gas Journal (2003), 101(36), pp. 66-68, 70, 72-73.
Bulow et al., "The mutual transformation of hydrogen sulphide and carbonyl sulphide and its role . . . ," Studies in Surface Science and Catalysts (1999), v. 120, 301-45.
Watson et al., "A comparison between commercially available sorbent materials for removal of COS from propane," 82nd GPA Annual Convention Proceeding (2003), 22 p.
Spala, E.E., "Adsorption of trace sulfur contaminants in liquid olefins using activated aluminas," 35th AIChe Annual Meeting (1988), 24 p.

* cited by examiner

*Primary Examiner* — Randy Boyer

(57) ABSTRACT

A method and apparatus for removing carbonyl sulfide (COS) from a hydrocarbon stream have been developed. The design allows removal of COS in the regeneration stream to less than 10 wppm, even at high concentrations of COS. The spent bed is regenerated using a portion of the treated product stream. The COS regeneration column provides increased contact and residence time.

15 Claims, 1 Drawing Sheet

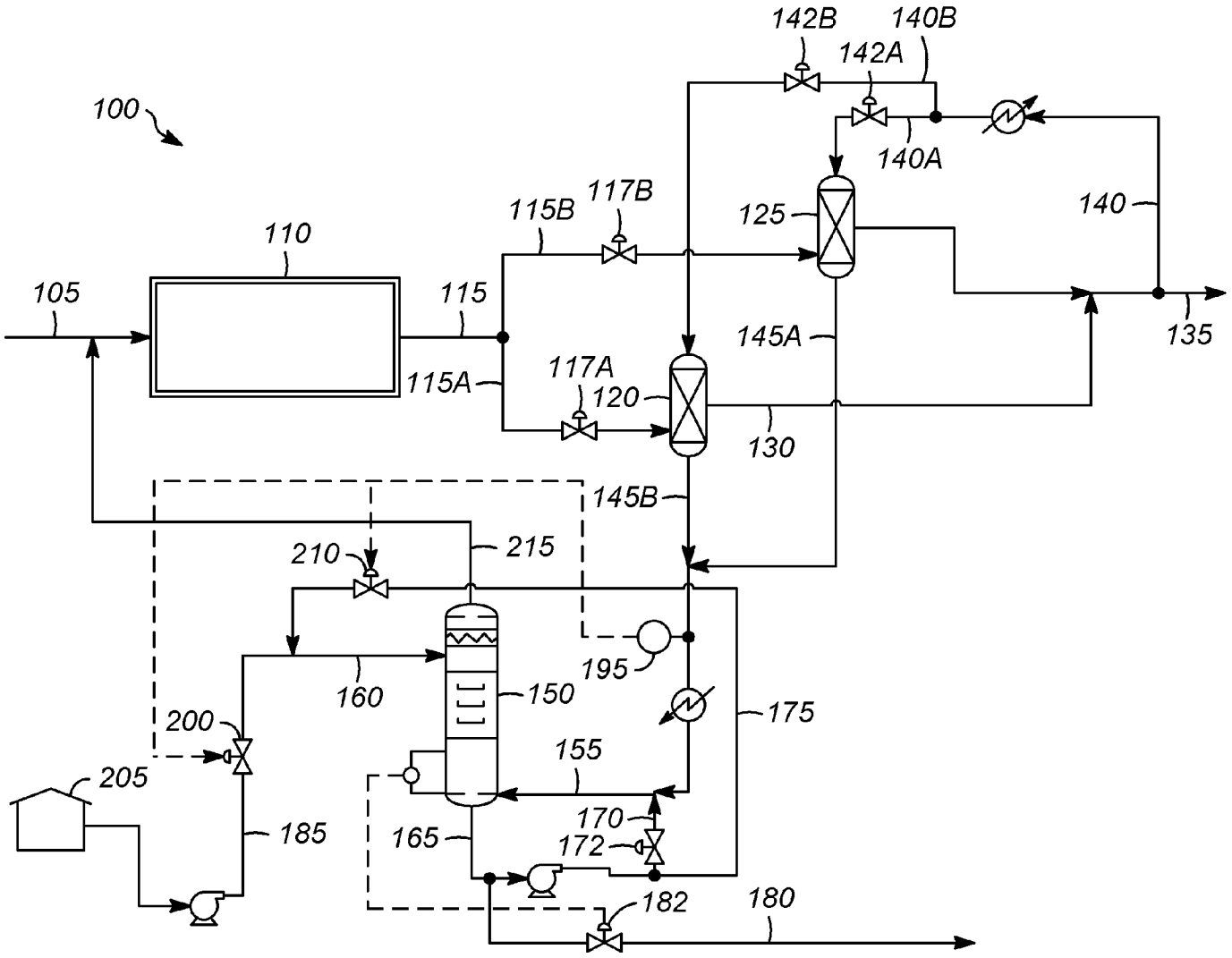
100
105
110
115
115A
115B
117A
117B
120
125
130
135
140
140A
140B
142A
142B
145A
145B
150
155
160
165
170
172
175
180
182
185
195
200
205
210
215

PROCESS FOR REMOVING CARBONYL SULFIDE FROM A HYDROCARBON STREAM

BACKGROUND OF THE INVENTION

Carbonyl sulfide (COS) is an undesirable impurity in materials such as petroleum hydrocarbons because it is a source of sulfur, and therefore a potential atmospheric pollutant. COS also acts as an undesirable contaminant of industrial processes by poisoning polymerization catalysts when present in petroleum-derived polymerizable olefins, such as propylene. COS may be present in such processes as a contaminant initially present in the feedstock, or it may be formed in a treating process, such as being the result of the molecular sieve-catalyzed reaction of carbon dioxide with hydrogen sulfide or other sulfur compounds.

Prior art methods of removing COS can be divided into three categories: distillation, hydrolysis, and the use of adsorbents. Each of these methods has certain disadvantages.

U.S. Pat. No. 3,315,003 discloses a process for removing COS from a hydrocarbon by first contacting the hydrocarbon with a liquid such as monoethanolamine which scrubs the hydrocarbon to remove acid gases such as $H_2S$ and $CO_2$ and part of the COS. The hydrocarbon is then distilled. After several subsequent distillations, the liquid bottom product is treated with a soda-lime to remove any remaining COS. However, distillation processes are extremely inefficient due to the cost of energy to vaporize virtually all of the liquid.

U.S. Pat. No. 3,265,757 teaches the catalytic hydrolysis of COS to form $H_2S$, using alumina as a catalyst. A mixture of the liquid hydrocarbon and water is contacted with a high surface area alkali-impregnated, active alumina containing from 0.15 to 3 wt-% of sodium or potassium at a temperature of from 20° to 50° C. The patent states that the hydrolysis reaction will not commence if the alumina is bone dry, and suggests either moistening the alumina catalyst with ion-free water prior to the reaction, or passing a mixture of ion-free water and the liquid hydrocarbon through the catalyst bed until a sufficient amount of water has built up on the alumina to permit the hydrolysis reaction to proceed. However, while this process does remove COS (by converting it to $H_2S$), it does not remove sulfur per se from the hydrocarbon, but merely changes the form of the sulfur compound which still must be subsequently removed from the hydrocarbon by another process step.

U.S. Pat. No. 4,455,446 teaches the removal of COS from propylene by hydrolysis over a catalyst comprising platinum sulfide on alumina. The patent states that the hydrolysis reaction may be carried out in either the gaseous or liquid phase with a temperature of 35° to 65° C. used for the liquid phase. An amount of water at least double the stoichiometric amount of the COS to be hydrolyzed must also be present.

The disadvantages of these prior art methods of removing COS include the requirement that the stream be preconditioned with water and that there be a subsequent treatment to remove both the hydrolysis products and the water. In addition, the residual COS content in the effluent may still be too high, especially in view of the requirements of the particular polymerization process downstream.

U.S. Pat. No. 4,835,338 describes a process for the removal of sulfur impurities from liquid hydrocarbons in which an activated alumina adsorbent is used to remove the COS from a liquid propylene stream. In this process, the absorbent is regenerated by passing a heated gas through the adsorbent. The disadvantage of this process is that after a few cycles, typically four to six regeneration cycles, the adsorbent COS capacity decreases in each successive cycle until it stabilizes at a level of about 40% of fresh equilibrium capacity. This low level of regeneration of the adsorbent means that a significantly higher quantity of adsorbent is required in order to achieve the desired removal of COS than would be necessary if complete regeneration of the adsorbent bed was achieved after each cycle.

U.S. Pat. No. 6,843,907, which is incorporated herein by reference, describes an improved adsorbent process. The process involves contacting a hydrocarbon stream containing COS with an adsorbent and then regenerating the adsorbent by passing a heated gas containing a hydrolyzing agent through the absorbent. The heated gas is generally heated to a temperature of from about 100° to 350° C. The adsorbent that is regenerated by using this process retains at least 70% of its capacity for adsorption of sulfur as compared to fresh adsorbent.

There remains a need for improved methods for removal of COS from hydrocarbon streams.

SUMMARY OF THE INVENTION

One aspect of the invention is a process for removing carbonyl sulfide from a hydrocarbon stream. In one embodiment, the process includes heating a portion of the hydrocarbon product stream to a regeneration temperature. The adsorbent in a spent adsorbent bed containing adsorbed carbonyl sulfide is regenerated by passing the heated portion of the hydrocarbon product stream through the spent adsorbent bed to desorb adsorbed carbonyl sulfide to form a hydrocarbon stream containing desorbed carbonyl sulfide. The hydrocarbon stream containing desorbed carbonyl sulfide is cooled after the temperature has been measured. A downwardly flowing aqueous solvent stream is introduced into a carbonyl sulfide removal column at a first flow rate, the aqueous solvent stream comprising at least one of a fresh aqueous solvent stream and a recycle aqueous solvent stream, the recycle aqueous solvent stream comprising a first portion of a bottoms stream from the carbonyl sulfide removal column. The cooled hydrocarbon stream is mixed with a second portion of the bottoms stream. The mixed stream is introduced into the carbonyl sulfide removal column at a location above an outlet for the bottoms stream and below an inlet for the aqueous solvent stream, the mixed stream separating into a hydrocarbon portion containing desorbed carbonyl sulfide and an aqueous portion, the hydrocarbon portion flowing up through the column, and the aqueous portion forming the bottoms stream. The flow rate of the fresh aqueous solvent stream is increased when the measured temperature of the hydrocarbon stream containing desorbed carbonyl sulfide reaches the carbonyl sulfide desorption temperature before cooling. The upward flowing hydrocarbon portion is counter currently contacted with the downward flowing aqueous solvent to remove the desorbed carbonyl sulfide from the hydrocarbon stream.

Another aspect of the invention is an apparatus for removing carbonyl sulfide from a hydrocarbon stream. In one embodiment, the apparatus includes at least two adsorbent beds, each bed having a hydrocarbon stream inlet, a regeneration stream inlet, a regeneration stream outlet, and a product stream outlet; a hydrocarbon stream line in selective fluid communication with the hydrocarbon stream inlet of the first and second adsorbent beds; a product stream line in selective fluid communication with the product stream outlet of the first and second adsorbent beds; a portion of the product stream line being in selective fluid communication with the regeneration stream inlet of the first and second adsorbent beds; a heating zone in thermal communication with the portion of the product stream line upstream of the first and second adsorbent beds; a carbonyl sulfide removal column having a regeneration stream inlet, a solvent stream inlet, a bottoms stream outlet, and an overhead stream outlet, the regeneration stream inlet being positioned above the bottoms outlet and below the solvent inlet, the solvent inlet being below the overhead outlet, the regeneration stream inlet of the carbonyl sulfide removal column being in selective fluid communication with the regeneration stream outlet of the first and second adsorbent beds; a regeneration stream line being in selective communication with the regeneration stream outlet of the first and second adsorbent beds and the regeneration stream inlet of the carbonyl sulfide removal column; a cooling zone in thermal communication with the regeneration stream line; a solvent stream line in fluid communication with the solvent inlet, the solvent stream line comprising a fresh solvent stream line and a recycle solvent stream line; a first portion of a bottoms stream line being in fluid communication with the regeneration stream line downstream of the cooling zone; a second portion of the bottoms stream line comprising the recycle solvent stream line, the recycle solvent stream line being in fluid communication with the fresh solvent stream line; and a temperature indicator in thermal communication with the regeneration stream line upstream of the cooling zone, the temperature indicator being in communication with a controller controlling a flow rate of the fresh solvent stream line and the recycle stream line.

BRIEF DESCRIPTION OF THE DRAWING

The FIGURE is an illustration of one embodiment of a process for removing COS from a hydrocarbon stream.

DETAILED DESCRIPTION OF THE INVENTION

Depending upon the process and the required purity of the product, it may be necessary to reduce the COS level in the starting material to below 1 part per million by weight (ppmw), and in certain polymerization processes to below 10 parts per billion weight (ppbw).

Absorbent beds can be used to reduce the level of COS in the hydrocarbon stream. However, when the beds are regenerated, the COS load in the regenerant stream can increase to over 10,000 wppm COS which cannot be removed by the standard COS removal vessel.

A process has been developed for COS removal which incorporates a column providing longer contact time and intimate mixing on the trays. The longer contact time provides better transfer to the COS solvent, which allows more COS to be transferred to the aqueous solvent. The design allows removal of COS in the regeneration stream to less than 10 wppm, even at high concentrations of COS. The spent bed is regenerated using a portion of the treated product stream. After the regeneration stream is treated in the COS regeneration column, it can then be returned to the feed stream of the caustic extraction zone, allowing any residual $H_2S$ created and not removed by the COS solvent to be removed by the caustic, and the residual COS to be removed by the on-stream COS adsorbent without recycle build-up.

The FIGURE illustrates one embodiment of the process 100. The hydrocarbon feed 105 is sent to the caustic extraction zone 110 for removal of $H_2S$ and mercaptan. The $H_2S$ and mercaptan-free stream 115 typically contains less than 1 wppm $H_2S$ and less than 5 wppm mercaptan.

The caustic extraction zone 110 is in selective fluid communication with adsorbent beds 120 and 125. One bed is in service for removal of COS (120 as illustrated), while the other bed has been loaded with COS and is undergoing regeneration (125 as illustrated). $H_2S$ and mercaptan-free stream 115 can be sent either to bed 120 via 115A when bed 120 is removing COS, or to bed 125 via 115B when bed 125 is removing COS. The connection is controlled by valves 117A and 117B. When bed 120 is removing COS, valve 117A is open and valve 117B is closed.

It should be understood that there could be more than two adsorbent beds, with some being used for adsorption, while others are being regenerated, repaired, or prepared for re-use, etc. Furthermore, when the first bed becomes loaded and the system switches to loading the second bed and regenerating the first bed.

The $H_2S$ and mercaptan-free stream 115 is sent to adsorbent bed 120 where COS is removed. Any disulfide present slips through because the adsorbent used does not adsorb disulfide.

Although it is customary in the industry to refer to the process of removal of COS from organic liquids to be adsorption, when the process is analyzed, it is found to be a strong chemisorption process. The COS may bind to discrete sites on the adsorbent, in the form of stable species such as hydrogen thiocarbonate and thiocarbonate. The process may be employed to remove COS from a range of hydrocarbons, including $C_1$ to $C_5$ hydrocarbons, including natural gas, LPG and propylene.

The adsorbent may comprise an alkali impregnated alumina, zeolite or mixture thereof, provided that the adsorbent has the capacity for adsorption of sulfur and sulfur compounds such as COS. Other adsorbents known to those skilled in the art may also be employed, such as alumina-zeolite composite adsorbents. More specifically, sodium doped aluminas that are useful in the present invention comprise from 3.5 to 6 mass % sodium as calculated as sodium oxide. The alumina-zeolite composites contain from about 20 to 50% X or Y-type zeolite. A useful composite alumina-zeolite adsorbent is doped with a metal component that is an alkali metal, an alkaline earth metal or a mixture thereof.

The adsorption process may be carried out at ambient temperature, although temperatures ranging from about 15° C. to about 100° C. may be used. If the hydrocarbon is at a temperature in this range after previous processing, it need not be heated or cooled prior to passing through the adsorbent.

The adsorption may be advantageously carried out in a packed column, although any other convenient form of maintaining contact between the adsorbent and the hydrocarbon may be employed, such as a slurry process. The flow rate of the hydrocarbon through the adsorbent should be sufficiently slow to allow a sufficient contact time to permit the desired adsorption of the COS in the hydrocarbon onto the adsorbent to occur. The actual amount of contact time will vary with the particle size and type of adsorbent.

The adsorption capacity of the adsorbent is determined by monitoring the sulfur content of the effluent 130 from the adsorbent bed 120. Prior to reaching its adsorption capacity, the effluent 130 will contain less than about 5 wppm sulfur, or less than 1 wppm sulfur. The effluent's carbonyl sulfide profile will consist of a zone of essentially no COS followed by a transient zone, where the COS concentration in the effluent slowly increases to close to the feed COS concentration. The transient zone is typically referred to as the mass transfer zone and is a function of flow rate, adsorbent particle size and process conditions. The total amount of sulfur, including COS, retained on the adsorbent in the steady state zone is defined as equilibrium capacity and can be easily calculated by one skilled in the art.

The treated hydrocarbon stream 130 exits adsorbent bed 120. The bulk 135 of the treated hydrocarbon stream 130 goes to product or further downstream processing. A portion 140 of the treated hydrocarbon stream 130 is sent to spent adsorbent bed 125 to regenerate the adsorbent. Typically, about 80 to about 95 vol % of the treated hydrocarbon stream 130 goes to product or downstream processing, while about 5 to about 20 vol % is used for regeneration.

The portion 140 is heated to a temperature of about 149° C. (300° F.) to about 316° C. (600° F.) and sent to adsorbent bed 125 via 140A when bed 125 is undergoing regeneration. If bed 120 were undergoing regeneration, it would flow to bed 120 via 140B. Valve 142A is open and valve 142B is closed when bed 125 is undergoing regeneration. As the adsorbent bed 125 heats up, it begins to desorb COS into the outlet flow stream 145A.

Stream 145A, which contains the desorbed COS, is cooled to a temperature in the range of about 38° C. (100° F.) to about 60° C. (140° F.) to maintain a constant temperature to the COS removal column 150. (When adsorbent bed 120 is being regenerated, stream 145B will be used.)

COS removal column 150 is a column with countercurrent flow. Stream 155, which contains desorbed COS, enters near the bottom of the COS removal column and flows upward, and COS solvent stream 160 enters near the top of the column and flows downward.

The COS solvent is an aqueous solvent. A suitable solvent includes sodium hydroxide, an amine, and water. Suitable amines include, but are not limited to, monoethanol amine (MEA), and diethanol amine (DEA). Other primary and secondary amines could be used, if desired.

Bottoms stream 165 from the COS removal column 150, which is primarily COS solvent, is split into three portions. Stream 170 is mixed with cooled stream 145A, which contains desorbed COS, to form stream 155. Stream 175, another portion of the bottoms stream 165, is recycled to the top of the COS removal column 150 where it forms part of COS solvent stream 160. Stream 180, another portion of the bottoms stream 165, is sent for disposal.

COS solvent stream 160 is formed from at least one of recycle stream 175 and fresh COS solvent stream 185. Typically, there is a constant flow rate of COS solvent stream 160 to the COS removal column 150. The flow rates of recycle stream 175 and fresh COS solvent stream 185 can be varied as needed to maintain a constant volumetric flow for stream 160. The volumetric flow rate of stream 180 is typically equal to that of fresh COS solvent stream 185 (i.e., when fresh solvent is added, spent solvent is removed at the same time and at the same rate). Most of the time, the COS removal column 150 operates using all, or substantially all, recycle solvent. When the measured temperature of stream 145A, which contains the desorbed COS, reaches the COS desorption temperature (typically about 204° C. (400° F.) to about 260° C. (500° F.)), controller 195 sends a signal to valve 200 to start or increase the flow of fresh COS solvent 185 from the COS solvent tank 205 and to valve 210 to reduce the flow of recycle COS solvent 175 by the amount of the flow of fresh COS solvent 185. When the desorption temperature is reached, the amount of COS desorbed increases to 5,000 to 10,000 wppm. The recycled COS solvent would allow the COS to slip through. Fresh solvent is introduced to increase the COS removal by providing more unreacted amine available to react with the COS. Because the COS solvent is spent by the reaction, this step also provide make-up for the COS solvent. The injection of fresh COS solvent is based on the calculated desorption time of COS that passes through a maximum that can exceed 5,000 to 10,000 wppm COS.

Stream 155, which enters the bottoms of the COS removal column 150, is a mixture stream 145A, which contains desorbed COS, and stream 170, which contains COS solvent. This mixture provides an initial contact between the COS solvent and the stream containing desorbed COS and helps to remove the COS spike and utilize the COS solvent more completely. The mixture passes through a distributor, which helps to distribute the liquid more evenly around the cross section of the column, at or near the bottom of the column, and the hydrocarbon phase and the aqueous phase disengage from each other. A portion of the desorbed COS from the hydrocarbon phase may react with the amine in the COS solvent and be transferred to the aqueous COS solvent. The aqueous phase exits from the column as bottoms stream 165.

The division of bottoms stream 165 into the three portions is controlled. The flow rate of stream 180 is controlled by valve 182 and is based on level control from the bottom of the COS removal column 150. Stream 170 is controlled by valve 172 to send COS solvent at between about 10 to about 20 vol % of stream 145A under typical conditions. Stream 175 is controlled to send about 5 to about 15 vol % of stream 145A to the top of the COS removal column 150 for COS removal.

However, when the temperature of stream 145A reaches the COS desorption temperature, controller 195 sends fresh COS solvent 185 to the COS solvent stream 160 due to the temperature rise, the flow of stream 175 is reduced by the flow rate of fresh COS solvent, and the flow rate to stream 155 via line 170 is increased proportionally. Fresh COS solvent is injected during the entire desorption peak (including time on both sides of the peak), and the time of fresh COS solvent injection is based on the calculated peak desorption time for COS. This increases the COS removal efficiency of the COS removal column 150, allowing large spikes in COS concentration to be managed. Prior art configurations did not address this problem.

After disengaging from the COS solvent in the bottom of the COS removal column 150, the hydrocarbon flows upward, countercurrently by density difference against the downward flowing COS solvent.

In some embodiments, the COS removal column 150 includes trays that are designed to increase residence time, such as with increased weir height, to account for the slower reaction of COS with the COS solvent. For example, the trays can be high velocity jet deck trays or sieve trays, for example. Alternatively, the COS removal column 150 can include other types of liquid-liquid contacting devices, such as packed beds or fiber film bundles, and the like.

The COS removal column 150 typically includes at least two stages to increase the contact and residence time to increase COS removal.

The COS in the hydrocarbon phase is transferred to the solvent and then reacts with the amine in the solvent.

The hydrocarbon with the COS concentration reduced to less than 10 wppm then flows upwardly through a hydrophilic coalescer to remove any free aqueous phase from the hydrocarbon and exits the COS removal column as stream 215. Stream 215 flows back and mixes with the feed 105 to the caustic extraction zone 110 where any $H_2S$ that may have formed and escaped from the COS removal column 150 is removed. Alternatively, stream 215 could be introduced directly into the caustic extraction zone 110.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for removing carbonyl sulfide from a hydrocarbon stream comprising:

heating a portion of a hydrocarbon product stream having less than 500 wppb carbonyl sulfide to a regeneration temperature;

regenerating an adsorbent in a spent adsorbent bed by passing the heated portion of the hydrocarbon product stream through the spent adsorbent bed to desorb adsorbed carbonyl sulfide to form a hydrocarbon stream containing desorbed carbonyl sulfide;

cooling the hydrocarbon stream containing desorbed carbonyl sulfide;

introducing a downwardly flowing aqueous solvent stream into a carbonyl sulfide removal column at a first flow rate, the aqueous solvent stream comprising at least one of a fresh aqueous solvent stream and a recycle aqueous solvent stream, the recycle aqueous solvent stream comprising a first portion of a bottoms stream from the carbonyl sulfide removal column;

mixing the cooled hydrocarbon stream with a second portion of the bottoms stream;

introducing the mixed stream into the carbonyl sulfide removal column at a location above an outlet for the bottoms stream and below an inlet for the aqueous solvent stream, the mixed stream separating into a hydrocarbon portion containing desorbed carbonyl sulfide and an aqueous portion, the hydrocarbon portion flowing up through the column, and the aqueous portion forming the bottoms stream;

increasing a flow rate of the fresh aqueous solvent stream when a measured temperature of the hydrocarbon stream containing desorbed carbonyl sulfide reaches a carbonyl sulfide desorption temperature before cooling;

counter currently contacting the upward flowing hydrocarbon portion with the downward flowing aqueous solvent to remove the desorbed carbonyl sulfide from the hydrocarbon stream.

2. The process of claim 1 further comprising decreasing a flow rate of the recycle aqueous solvent stream to maintain the first flow rate.

3. The process of claim 1 wherein the hydrocarbon product stream having less than 500 wppb carbonyl sulfide is formed by contacting a hydrocarbon stream containing carbonyl sulfide with an adsorbent to adsorb the carbonyl sulfide.

4. The process of claim 3 further comprising:

introducing a hydrocarbon feed stream into a sulfur removal zone to remove hydrogen sulfide and mercaptans; and introducing an overhead stream from the carbonyl sulfide removal column to the sulfur removal zone.

5. The process of claim 4 wherein an effluent from the sulfur removal zone comprises the hydrocarbon stream containing carbonyl sulfide.

6. The process of claim 4 wherein the sulfur removal zone is a caustic extraction zone.

7. The process of claim 1 further comprising removing a third portion of the bottoms stream to prevent flooding of the carbonyl sulfide removal column and prevent the hydrocarbon from leaving the bottom of the column with the solvent.

8. The process of claim 1 wherein the carbonyl sulfide removal column contains at least one high velocity jet deck tray.

9. The process of claim 1 wherein the carbonyl sulfide removal column contains at least two stages.

10. The process of claim 1 wherein the portion of the hydrocarbon product stream is in the range of about 5 vol % to about 20 vol % of the hydrocarbon product stream.

11. The process of claim 1 wherein the regeneration temperature is in a range of from about 149° C. to about 316° C.

12. The process of claim 1 wherein the hydrocarbon stream containing desorbed carbonyl sulfide is cooled to a temperature in a range of about 38° C. to about 60° C.

13. The process of claim 1 wherein there are at least two adsorbent beds, and wherein contacting a hydrocarbon stream containing carbonyl sulfide with an adsorbent takes place in a first bed and a second bed is the spent adsorbent bed.

14. The process of claim 13 wherein the first and second beds are alternately contacted with the hydrocarbon stream containing carbonyl sulfide and regenerated.

15. The process of claim 1 wherein a hydrocarbon stream exiting the carbonyl sulfide removal column contains less than 10 wppm carbonyl sulfide.

* * * * *